US011518000B2

(12) United States Patent
Valentini

(10) Patent No.: US 11,518,000 B2
(45) Date of Patent: Dec. 6, 2022

(54) BACKING PAD,ORBITAL SANDER OR POLISHER WITH SUCH A BACKING PAD, AND SHEET-LIKE SANDING OR POLISHING MEMBER FOR RELEASABLE ATTACHMENT TO SUCH A BACKING PAD

(71) Applicant: Guido Valentini, Milan (IT)

(72) Inventor: Guido Valentini, Milan (IT)

( * ) Notice: Subject to any disclaimer, the term of this patent is extended or adjusted under 35 U.S.C. 154(b) by 399 days.

(21) Appl. No.: 16/535,310

(22) Filed: Aug. 8, 2019

(65) Prior Publication Data

US 2020/0070316 A1 Mar. 5, 2020

(30) Foreign Application Priority Data

Sep. 5, 2018 (EP) ..... 18192719

(51) Int. Cl.
*B24D 11/02* (2006.01)
*B24B 23/02* (2006.01)
(Continued)

(52) U.S. Cl.
CPC ..... *B24D 11/02* (2013.01); *B24B 23/02* (2013.01); *B24B 23/04* (2013.01); *B24B 55/00* (2013.01); *B24D 3/002* (2013.01)

(58) Field of Classification Search
CPC ..... B24B 23/00; B24B 23/04; B24B 23/02; B24B 45/006; B24B 45/00; B24D 11/02; B24D 3/002; B24D 9/08; B24D 13/20
(Continued)

(56) References Cited

U.S. PATENT DOCUMENTS 5,967,886 A * 10/1999 Wuensch ..... B24B 23/04 451/421
9,120,197 B2 * 9/2015 Kuehne ..... B24B 23/04
(Continued)

FOREIGN PATENT DOCUMENTS

CN 109531312 A * 3/2019 ..... B24B 23/00
CN 109531312 A 3/2019
(Continued)

OTHER PUBLICATIONS

Bosch 1294VSK 2.3 Amp Corner Detail Sander Kit, https://us.amazon.com/Bosch-1294VSK-Corner-Detail-Sander/dp/B0000302U5 , Oldest Review 2013, Accessed Sep. 17, 2021.*
(Continued)

*Primary Examiner* — Joseph J Hail
*Assistant Examiner* — Arman Milanian
(74) *Attorney, Agent, or Firm* — Ware, Fressola, Maguire & Barber LLP

(57) ABSTRACT

The invention refers to a backing pad (100) for use with a hand-held or hand-guided orbital sander (10) or polisher. The backing pad (100) has a planar extension and an essentially triangular form comprising a triangular region (102), with a top surface for releasable attachment of the backing pad (100) to the sander (10) or polisher and with a bottom surface for releasable attachment of a sheet-like sanding or polishing member (132) to the backing pad (100). In order to provide for a possibility to sand or polish surfaces within narrow, cramped, tight, twisty and crooked spaces with a sander (10) or polisher having an essentially triangular backing pad (100), it is suggested that the backing pad (100) comprises at least at one of the three corners (104) of
(Continued)

the triangular region (102) a protrusion (108) extending in the plane of the planar extension of the backing pad (100) and projecting laterally beyond the triangular region (102).

17 Claims, 8 Drawing Sheets

(51) Int. Cl.
*B24D 3/00* (2006.01)
*B24B 23/04* (2006.01)
*B24B 55/00* (2006.01)

(58) Field of Classification Search
USPC ..... 451/354, 357, 350, 351, 356, 494, 344, 451/359, 458
See application file for complete search history.

(56) References Cited

U.S. PATENT DOCUMENTS

| | | | | |
|---|---|---|---|---|
| 2003/0152737 | A1 | 8/2003 | Shermer et al. | |
| 2005/0170765 | A1 | 8/2005 | Shermer et al. | |
| 2006/0068688 | A1* | 3/2006 | Kiss | B24B 23/04 451/357 |
| 2012/0003905 | A1* | 1/2012 | Leung | B24B 27/0076 451/356 |
| 2013/0244554 | A1 | 9/2013 | Shermer et al. | |

FOREIGN PATENT DOCUMENTS

| | | | | |
|---|---|---|---|---|
| DE | 29923017 | U1 | 2/2000 | |
| EP | 1334801 | A1 | 8/2003 | |
| EP | 2669044 | A1 | 5/2013 | |
| EP | 2636483 | A1 * | 9/2013 | B24B 23/03 |
| EP | 2735402 | A1 * | 5/2014 | B24B 23/04 |
| EP | 2735402 | A1 | 5/2014 | |

OTHER PUBLICATIONS

English language Abstract of EP1334801A1.
English language Abstract of EP2669044A1.
English language Abstract not available for DE29923017.
English language translation of CN109531312A.

* cited by examiner

BACKING PAD,ORBITAL SANDER OR POLISHER WITH SUCH A BACKING PAD, AND SHEET-LIKE SANDING OR POLISHING MEMBER FOR RELEASABLE ATTACHMENT TO SUCH A BACKING PAD

BACKGROUND OF THE INVENTION

1. Field of the Invention

The present invention refers to a backing pad for use with a hand-held or hand-guided orbital sander or polisher.

2. Brief Description of the Related Art

Triangular backing pads of the above-identified kind are well known in the art. The form of the backing pad is regarded as being "essentially" triangular because its form does not have to be a triangle in the strictly mathematical sense. Preferably, the form of the conventional backing pads comprises three corners and lines interconnecting the corners. The three corners usually form an equilateral or isosceles triangle. The backing pads are usually mounted to a sander or polisher in such a way that one of their corners, in particular in an isosceles triangle the corner forming an acute angle, points to the front of the sander or polisher. The lines interconnecting the corners may be straight or curved. The form of a backing pad having the form of an isosceles triangle with convex lines curved to the outside of the backing pad is called a delta-shape.

Furthermore, sheet-like sanding or polishing members of the above-identified kind are well known in the art. The sanding or polishing members are releasably attached to the bottom surface of a backing pad by releasable attachment means, for example a hook-and-loop fastener. An abrasive material provided on the bottom surface of a sanding member may comprise, for example, mineral, mineral-like or synthetic stone particles. A polishing material provided on the bottom surface of a polishing member may comprise, for example, micro fibre, wool, or foam material. The circumferential form of the sheet-like sanding or polishing member essentially corresponds to the circumferential form of the respective backing pad, to which it is releasably attached, in particular to the circumferential form of the bottom surface of the backing pad. In this respect "essentially" means that the sheet-like sanding or polishing member may have a surface slightly deviating from the respective backing pad bottom surface but in its overall circumferential form corresponds to the overall circumferential form of the respective backing pad bottom surface. For example, there are sheet-like sanding or polishing members available having the form of an equilateral or isosceles triangle with curved or straight lines interconnecting the corners of the triangle. In particular, sanding or polishing members of various sizes having a delta-shape are well-known.

Orbital sanders or polishers having an essentially triangular backing pad releasably attached thereto and performing an orbital working movement during operation of the sander or polisher are often used for working wood or metal surfaces in order to remove material, e.g. paint coat, excessive filling compound, corroded or weathered material. Such sanders or polishers are often used to work surfaces in narrow, cramped, tight, twisty and crooked spaces. However, these spaces cannot be reached very well with the known essentially triangular shaped backing pads. In particular, the housing of the sander or polisher located essentially above the backing pad is often in the way when the user wants to reach these spaces in order to sand or polish the surfaces within the spaces.

SUMMARY OF THE INVENTION

Therefore, it is an object of the present invention to provide for a possibility to sand or polish surfaces within narrow, cramped, tight, twisty and crooked spaces with a sander or polisher having an essentially triangular backing pad.

The backing pad has a planar extension and in a top view an essentially triangular form comprising a triangular region. It has a top surface for releasable attachment of the backing pad to the sander or polisher and a bottom surface for releasable attachment of a sheet-like sanding or polishing member to the backing pad.

Further, the invention refers to a sheet-like sanding or polishing member having an essentially triangular form. The sanding or polishing member has a top surface for releasable attachment to a bottom surface of a backing pad of a hand-held or hand-guided orbital sander or polisher and a bottom surface with an abrasive or polishing material. The form of the sanding or polishing member essentially corresponds to the form of the backing pad, to which it is adapted to be attached.

Finally, the present invention refers to an orbital sander or polisher comprising a backing pad releasably attached thereto and performing an orbital working movement upon activation and during intended use of the sander or polisher.

Starting from the backing pad of the above-identified kind it is suggested that the backing pad comprises at least at one of the three corners of the triangular region a protrusion extending in the plane of the planar extension of the backing pad and projecting laterally beyond the triangular region.

The backing pad according to the present invention does not only comprise the essentially triangular region but additionally at least one protrusion extending beyond the triangular region. In the sense of the present invention an essentially triangular form of the backing pad comprises the triangular region with three corners and lines, in particular convex lines curved outwards, interconnecting the corners. Besides the triangular region, the essentially triangular form of the backing pad further includes the at least one protrusion at one or more of the three corners of the triangular region. Despite the protrusion, the form of the backing pad according to the present invention is still considered essentially triangular. Preferably, the backing pad comprises only one protrusion located at one corner of the triangular region of the backing pad, in particular in a delta-shaped backing pad at the corner forming an acute angle. The corners of the backing pad may be rounded.

Preferably, the backing pad is releasably attached to the sander or polisher in such an orientation that the protrusion of the backing pad points to the front of the sander or polisher. With the protrusion extending to the front of the sander or polisher, the protrusion can easily reach surfaces within narrow, cramped, tight, twisty and crooked spaces. In particular, the protrusion protrudes beyond a housing of the sander or polisher, thereby allowing insertion of the protrusion even in particularly low and deep spaces. Summing up, the present invention allows for a much more sophisticated and detailed sanding and polishing of surfaces.

Preferably, the backing pad comprises a resilient support structure made of a rigid or semi-rigid material, e.g. plastic or metal or a compound of different materials, and a flexible yielding layer made of an elastically deformable, soft material, e.g. rubber or foam rubber, inextricably fixed to a bottom surface of the support structure, e.g. by gluing, welding or co-moulding. A top surface of the support structure is preferably provided with attachment means (e.g. a recess) for releasable attachment of the backing pad to a sander or polisher. A bottom surface of the yielding layer comprises attachment means (e.g. a first surface of a hook-and-loop fastener) for releasable attachment of the sheet-like sanding or polishing member to the backing pad. The sheet-like sanding or polishing member comprises corresponding attachment means (e.g. a second surface of a hook-and-loop fastener) on its top surface for interacting with the attachment means of the yielding layer.

According to a preferred embodiment of the present invention the protrusion essentially has the form of a triangle, in particular an isosceles triangle, with a pointed tip at its distal end. Lateral lines limiting the protrusion to the sides and running together at the tip of the protrusion may be straight or curved, in particular they may be convex lines curved outwards. The lateral lines limiting the protrusion to its sides interconnect lateral lines of the triangular region of the backing pad with the tip of the protrusion.

Alternatively, the protrusion has the form of an isosceles trapezoid or a rectangle with a tip comprising a straight or curved line. The protrusion has a longitudinal extension running from the attachment means (e.g. the recess) in the triangular region, where the backing pad is releasably attached to the sander or polisher, to the centre of the tip of the protrusion. Preferably, the width (essentially perpendicular to the longitudinal extension) of the trapezoid form becomes smaller towards the tip of the protrusion. In the case of a straight line at the tip of the protrusion, the line preferably extends perpendicular to the longitudinal extension of the protrusion. In the case of a curved line, the tip preferably comprises a convex line curved outwards. The lateral lines limiting the protrusion to the sides and running towards the tip of the protrusion may be straight or curved, in particular they may be convex lines curved outwards. The lateral lines limiting the protrusion to its sides interconnect lateral lines of the triangular region of the backing pad with the ends of the line forming the tip of the protrusion.

It is further suggested that the triangular region of the backing pad and the protrusion have a discontinuous transition at their lateral lines. In particular, it is suggested that the backing pad comprises a discontinuity at transition points between lateral lines limiting the triangular region of the backing pad and the lateral lines limiting the protrusion to their sides.

Of course, the new and innovative form of the backing pad according to the present invention requires a corresponding sheet-like sanding or polishing member having a form essentially corresponding to the form of the backing pad, in particular to the form of the bottom surface of the backing pad, to which the sheet-like sanding or polishing member is intended to be attached. The present invention also refers to such a sheet-like sanding or polishing member having the proposed special form. In particular, the sanding or polishing member of the invention not only comprises a triangular region (e.g. an isosceles or delta-shaped triangle with straight or curved lateral lines) but also at least one protrusion formed at least at one of the corners of the triangular region and extending beyond the triangular region. Depending on the different forms of the triangular region and/or of the protrusion, different forms of sheet-like sanding or polishing members are suggested.

The sanding or polishing member is adapted for being releasably attached to the bottom surface of the backing pad, for example by means of a hook-and-loop fastener. To this end a top surface of the sanding or polishing member comprises first attachment means (e.g. a first layer of a hook-and-loop fastener) adapted for interacting with second attachment means (e.g. a second layer of a hook-and-loop fastener) provided on a bottom surface of the backing pad in order to realise the releasable attachment of the sanding or polishing member to the backing pad. In particular, the first attachment means are also provided in the region of the protrusion of the sanding or polishing member. A bottom surface of the sanding or polishing member comprises an abrasive or polishing material. An abrasive material may comprise, for example, mineral, mineral-like or synthetic stone particles. A polishing material may comprise, for example, micro fibre, wool, or foam material. In particular, the abrasive or polishing material is also provided in the region of the protrusion of the sanding or polishing member.

According to another preferred embodiment of the present invention it is suggested that at least a tip of the protrusion has a thickness smaller than the thickness of the backing pad in the triangular region. In particular, it is suggested that the thickness of the backing pad decreases along the protrusion starting from the triangular region towards the tip of the protrusion. This embodiment allows an even easier insertion of the protrusion into narrow, cramped, tight, twisty and crooked spaces. Furthermore, the thinner material towards the tip of the protrusion provides for additional flexibility of the backing pad in the region of the protrusion thereby permitting an effective work even on curved and/or slanted surfaces.

Preferably, the top surface of the backing pad or of the rigid support structure, respectively, comprises attachment means for releasable attachment of the backing pad to the sander or polisher. The attachment means comprise at least one recess being adapted for receiving at least one respective protruding driving element of the sander or polisher in an axial direction. The at least one recess has an inner circumferential form corresponding to an outer circumferential form of the at least one respective driving element. In particular, it is suggested that the attachment means comprises a single central recess having a non-circular (e.g. triangular, rectangular, hexagonal, octagonal) inner circumferential form.

It is further suggested that once introduced into the at least one respective recess, the at least one driving element may be releasably fixed to the backing pad in an axial direction by means of fixing means. The fixing means may comprise a screw introduced from a bottom side of the backing pad or of the flexible yielding layer, respectively, through a hole in the backing pad in the region of a central recess and screwed into a threaded bore provided in a bottom side of the driving element. Alternatively, the fixing means may comprise first magnetic elements, in particular first permanent magnets, located in the at least one recess, preferably in the bottom of the recess, facing the at least one respective driving element after its introduction into the at least one recess and adapted for magnetically interacting with second magnetic elements, in particular second permanent magnets or ferromagnetic elements, making part of or being attached to the at least one respective driving element. Thus, the backing pad is releasably attached to the driving element of the sander or polisher in an axial direction by means of magnetic force.

The driving element is preferably attached to an eccentric element of the sander or polisher in a freely rotatable manner, e.g. by means of bearings provided in the eccentric element. The eccentric element transforms a purely rotational movement of a driving shaft of the sander or polisher into an orbital movement. Despite the freely rotatable attachment of the driving element to the eccentric element, rotational movement of the backing pad in respect to the eccentric element is prevented by blocking means. These can comprise, e.g. a circumferential collar made of a flexible material, e.g. soft plastic or rubber, interconnecting the housing of the sander or polisher on the one hand and the backing pad on the other hand. Due to its flexibility, the collar permits an orbital movement in the plane of the planar extension of the backing pad. However, the collar prevents a rotational movement of the backing pad in respect to the eccentric element and the sander or polisher, respectively, about an axis extending essentially parallel to the rotational axis of the driving shaft.

Alternatively, the rotational movement of the baking pad in respect to the eccentric element and the housing of the sander or polisher, respectively, may be prevented by means of magnetic force. The blocking means may comprise one or more magnetic elements (e.g. permanent magnets) located on the top surface of the backing pad and one or more further magnetic elements (e.g. permanent magnets or ferromagnetic elements) located at corresponding positions of the housing of the sander or polisher essentially opposite to the magnetic elements of the backing pad. The magnetic force acting between the magnetic elements of the backing pad and the magnetic elements of the housing permits an orbital movement but at the same time prevents a rotational movement of the backing pad in respect to the housing of the sander or polisher. To this end, it is suggested that the top surface of the backing pad comprises a plurality of third magnetic elements, in particular third permanent magnets, adapted to magnetically interact with fourth magnetic elements, in particular fourth permanent magnets or ferromagnetic elements, attached to a bottom surface of a housing of the sander or polisher opposite to the backing pad at positions corresponding to the positions of the third magnetic elements of the backing pad.

Finally, the present invention also suggests an orbital sander or polisher comprising a backing pad according to the present invention, which is releasably attached thereto and which performs an orbital working movement upon activation and during intended use of the sander or polisher.

BRIEF DESCRIPTION OF THE DRAWING

Further features and advantages of the present invention will become apparent from the following description of preferred embodiments with reference to the accompanying drawings. These show.

DETAILED DESCRIPTION OF THE INVENTION

Figure 1:
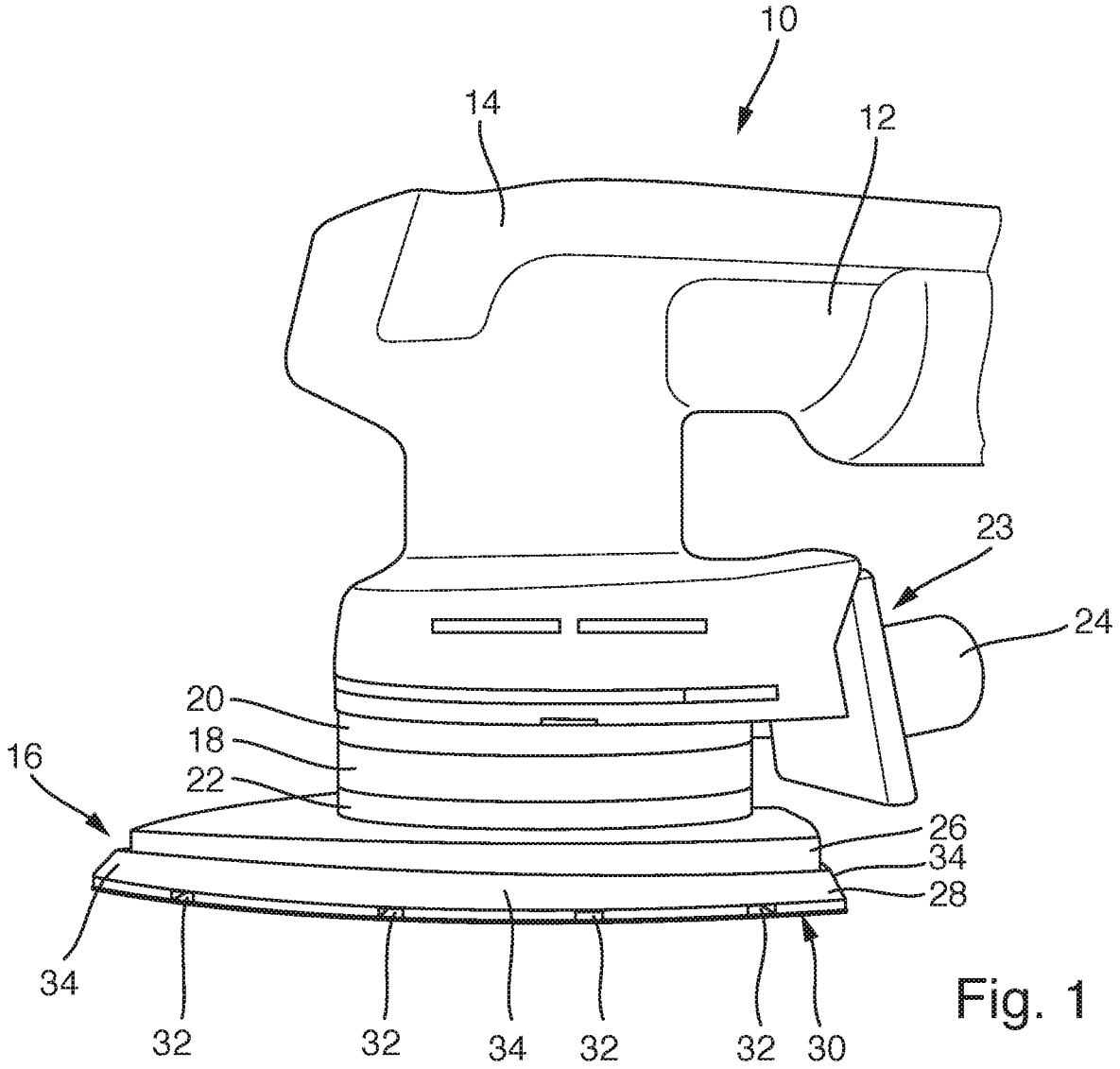
FIG. 1 part of a hand-held or hand-guided orbital sander known in the art.

FIG. 1 shows an example of a hand-held or hand-guided orbital sander 10 known in the art. The sander 10 comprises a housing 12 usually made of a plastic material. The housing 12 comprises a handle (not visible in FIG. 1) at a rear part of the sander 10 and a grip section 14 on top of a front part of the sander 10. A motor, at least one gear mechanism, an electronic control unit and other components may be provided in the housing 12 but are not visible in FIG. 1. The motor may be an electric motor, preferably a brushless motor, powered by electric energy from a mains power supply or from a rechargeable battery. Alternatively, the motor may be a pneumatic motor powered by a compressed air supply. The sander 10 is further provided with one or more switches and/or rotary controls (not visible in FIG. 1) for turning the motor on and off and for adapting the rotational speed of the motor to the surface to be worked and/or to the type of abrasive material of the sheet-like sanding member used.

Figure 2:
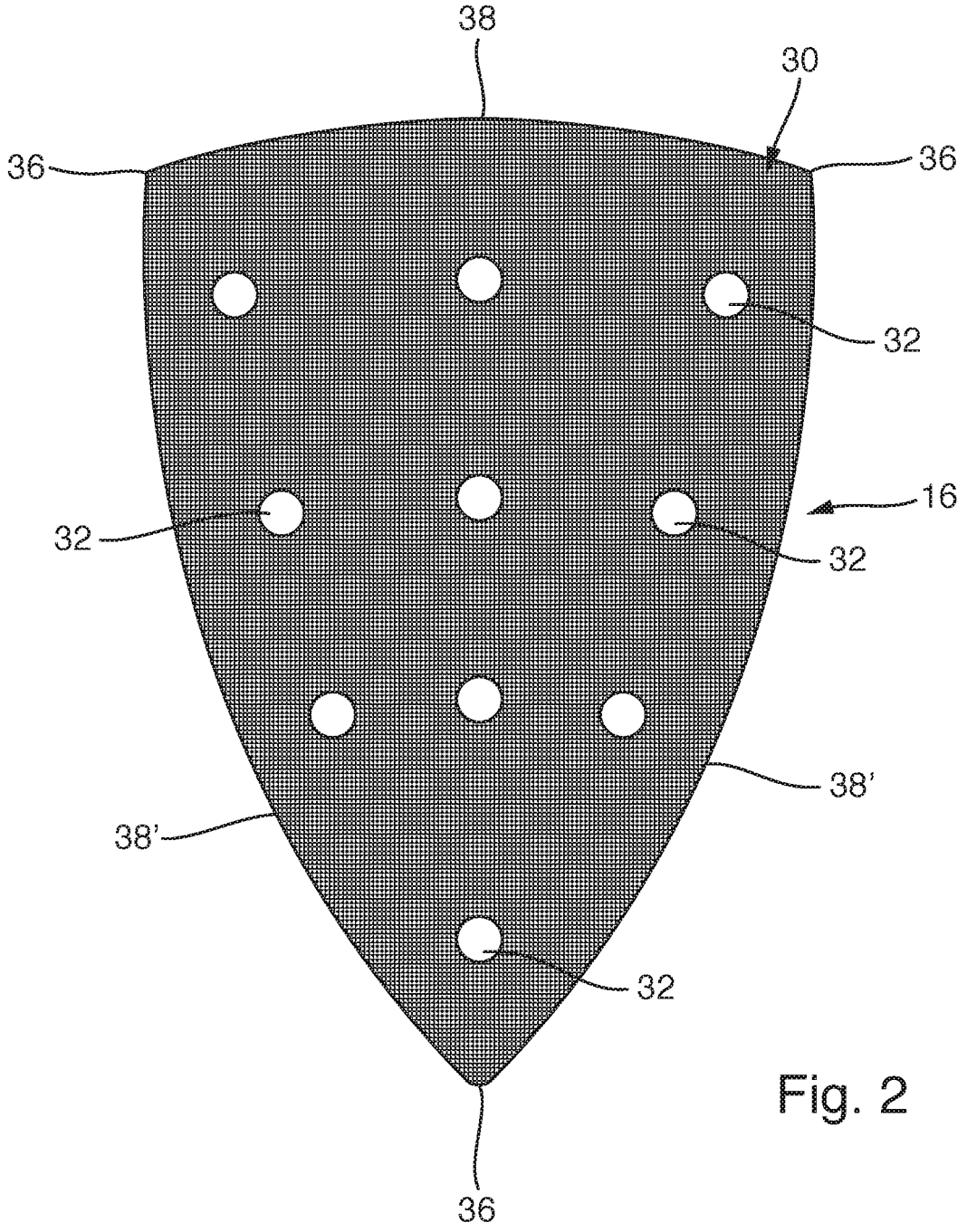
FIG. 2 a bottom view of a backing pad for use with the sander of FIG. 1 known in the art.

Upon activation of the motor a drive shaft of the sander 10 is brought into a rotational movement. An eccentric element is attached to the drive shaft in a torque-proof manner. A driving element protruding at the bottom side of the housing 12 is attached to the eccentric element in a freely rotatable manner, for example by means of bearings provided in the eccentric element. A rotational axis of the driving element runs essentially parallel to and spaced apart from a rotational axis of the drive shaft. Hence, rotation of the drive shaft provokes an orbital movement of the driving element about the rotational axis of the drive shaft. A backing pad 16 is releasably attached to the sander 10, in particular to the protruding driving element. A bottom view of the backing pad 16 is shown in FIG. 2. Upon operation of the sander 10, the backing pad 16 performs an orbital movement together with the driving element. In order to prevent the backing pad 16 from rotating in respect to the eccentric element about the rotational axis of the driving element, the prior art has a circumferential collar 18 made of flexible material, e.g. plastic or soft rubber, interconnecting the housing 12 of the sander 10 on the top 20 and the backing pad 16 on the bottom 22. Due to its flexibility, the collar 18 permits an orbital movement of the backing pad 16 in the plane of its planar extension. However, the collar 18 prevents a rotational movement of the backing pad 16 in respect to the eccentric element and the housing 12, respectively, about the driving element's rotational axis.

Finally, the known sander 10 may have a dust extraction mechanism 23 comprising a fan located inside the housing 12 and adapted for aspirating dust-laden air from the surface currently worked by the sander 10 and/or from the surrounding environment. Further, the dust extraction mechanism 23 comprises a duct system for conveying the dust-laden air to a connection nozzle 24 to which a hose of a dust suction device, for example a vacuum cleaner, can be attached. The fan and the duct system are provided inside the housing 12 and are not visible in FIG. 1.

The backing pad 16 comprises a resilient support structure 26 made of a rigid or semi-rigid material, e.g. plastic or metal or a compound of different materials. Further, the backing pad 16 comprises a flexible yielding layer 28 made of an elastically deformable, soft material, e.g. rubber or foam rubber, inextricably fixed to a bottom surface of the support structure 26, for example by gluing, welding or co-moulding. A top surface of the support structure 26 is provided with attachment means (not visible in FIG. 1) for releasable attachment of the backing pad 16 to the driving element of the sander 10. A bottom surface of the yielding layer 28 comprises attachment means 30 (e.g. a first surface of a hook-and-loop fastener) for releasable attachment of the sheet-like sanding member (not shown in FIG. 1) to the backing pad 16. The sheet-like sanding member comprises on its top surface corresponding attachment means (e.g. a second surface of a hook-and-loop fastener) for interacting with the attachment means 30 of the yielding layer 28 in order to achieve the releasable attachment of the sheet-like sanding member to the bottom surface of the backing pad 16. The backing pad 16 may be provided with a plurality of holes 32 and internal channels through which the dust-laden air from the surface currently worked by the sander 10 and/or the surrounding environment is aspirated. It can be seen in FIG. 1 that the yielding layer 28 has a slanted lateral circumferential surface 34 due to which the bottom surface of the yielding layer 28 is larger than its top surface and the bottom surface of the supporting structure 26, respectively.

FIG. 2 shows a bottom view of the backing pad 16 known in the art. The backing pad 16 has an essentially planar extension. The attachment means 30 provided on the bottom surface of the yielding layer 28 are clearly visible. Furthermore, it can be well seen that in a view perpendicular to the planar extension of the backing pad 16 it has an essentially triangular shape. In this example the backing pad 16 has the form of an isosceles triangle comprising three corners 36 and three lateral lines 38, 38' interconnecting the corners 36 and limiting the backing pad 16 to the sides. The opposing lines 38' have the same length and are longer than the baseline 38. The lines 38, 38' have a convex shape and are curved outwards. Such a form of a backing pad is also called a delta-shape and is well-known in the art.

A problem with the known sander 10 having the essentially triangular backing pad 16 is that narrow, cramped, tight, twisty and crooked spaces cannot be reached with the backing pad 16. Therefore, the present invention suggests a completely new and innovative form of the backing pad, as well as a hand-held or hand-guided sander or polisher having such a new and innovative backing pad and a sheet-like sanding or polishing member having the same new and innovative form as the backing pad, to which it is adapted to be attached. The invention is described in more detail with reference to FIGS. 3 to 8 showing preferred embodiments of the new and innovative backing pad 100 in various views.

Figure 7:
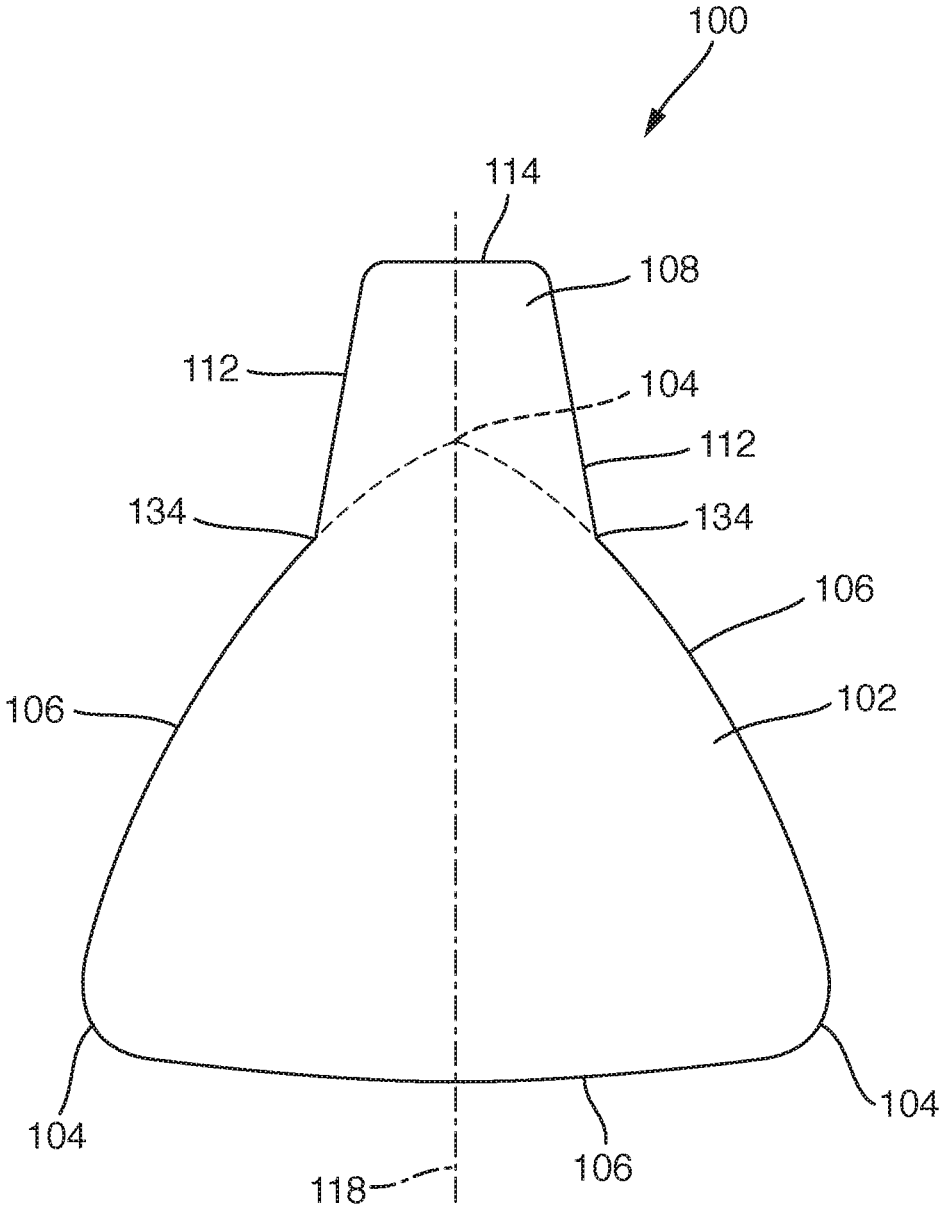
FIG. 7 a bottom view of yet another embodiment of a backing pad according to the present invention.
Figure 8:
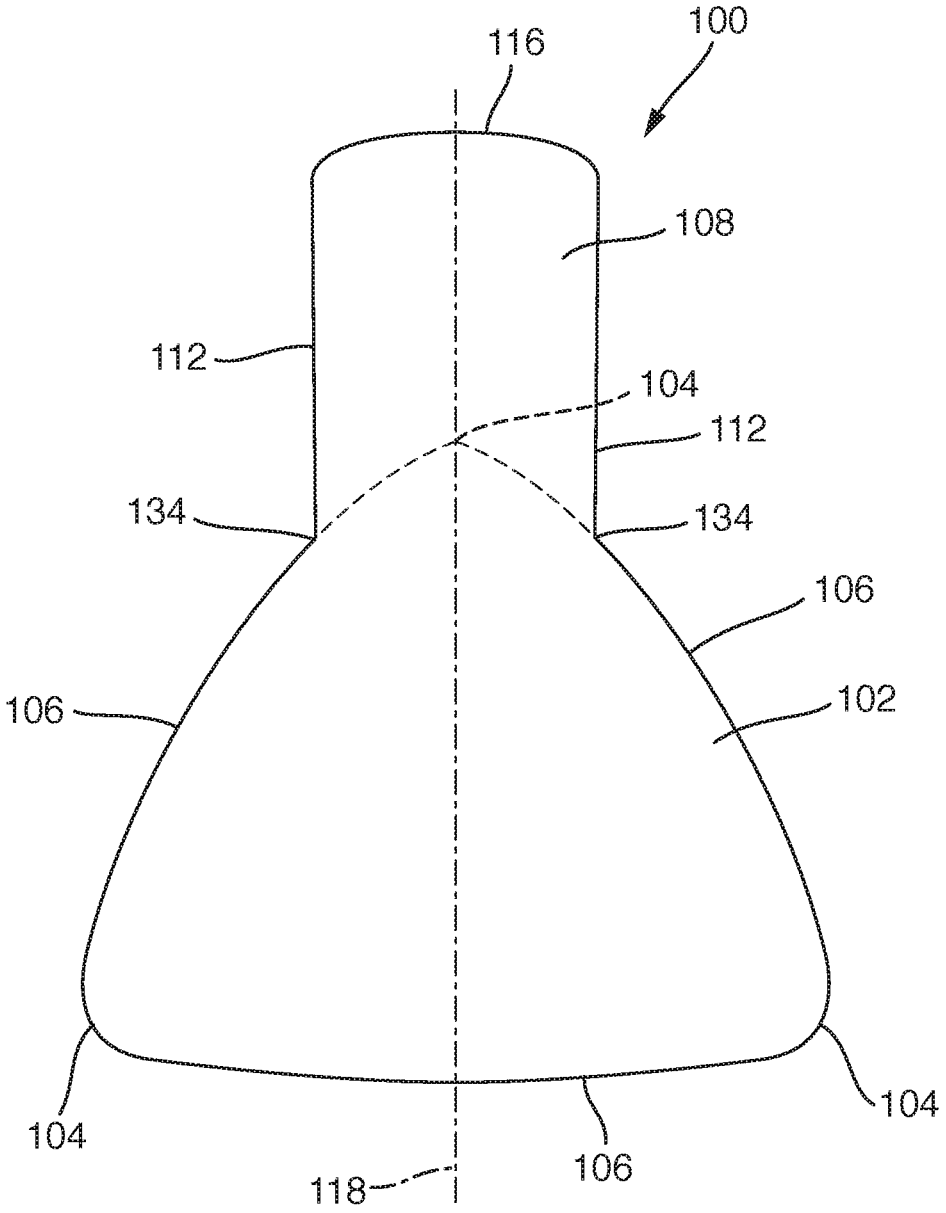
FIG. 8 a bottom view of yet another embodiment of a backing pad according to the present invention.

In the embodiment shown in FIGS. 3 to 5 the backing pad 100 also has an essentially triangular form, which is described with reference to FIGS. 5 to 8. The essentially triangular form comprises a triangular region 102 with three corners 104 and three lateral lines 106 interconnecting the corners 104 and limiting the triangular region 102 of the backing pad 100 to the sides. The corners 104 are rounded and the lines 106 are convex and extend outwards. In the embodiments of FIGS. 5, 7 and 8, the rectangular region 102 essentially corresponds to an equilateral triangle. However, the triangular region 102 of the backing pad 100 could also have a delta-shape (see FIG. 6) or any other essentially triangular shape. Furthermore, the essentially triangular form of the backing pad 100 comprises a protrusion 108 extending in the plane of the planar extension of the backing pad 100 and projecting laterally beyond the triangular region 102. In the shown preferred embodiments, the backing pad 100 is provided with only one protrusion 108. However, it would also be possible to provide the backing pad 100 with more than one protrusion 108. The protrusion 108 is provided at one of the three corners 104 of the triangular region 102, preferably in a delta-shaped backing pad 100 (see FIG. 6) at that corner 104' which forms an acute angle. Despite the protrusion 108, the form of the backing pad 100 is considered essentially triangular in the sense of the invention. The backing pad 100 preferably comprises a discontinuity at transition points 134 between the lateral lines 106 limiting the triangular region 102 of the backing pad 100 and lateral lines 112 limiting the protrusion 108 at its sides.

The backing pad 100 is releasably attached to the sander 10 and the driving element, respectively, in such an orientation that the protrusion 108 of the backing pad 100 points to the front of the sander 10. In this manner, the protrusion 108 can easily reach surfaces within narrow, cramped, tight, twisty and crooked spaces. In particular, the protrusion 108 protrudes well beyond the housing 12 of the sander 10, thereby allowing insertion of the protrusion 108 even in particularly deep and low spaces.

In the embodiments shown in FIGS. 3 to 6 the protrusion 108 has the form of a triangle, in particular an isosceles triangle, with a pointed tip 110 at its distal end. Of course, the tip 110 can also be slightly rounded. Convex lateral lines 112 limiting the protrusion 108 to the sides and interconnecting the lateral lines 106 of the triangular region 102 with the tip 110 of the protrusion 108, where they run together, are curved outwards. Of course, the lateral lines 112 could also be straight lines.

Alternatively, the protrusion may have the form of a trapezoid, preferably an isosceles trapezoid (see FIG. 7) or a rectangle (see FIG. 8) with a tip comprising a straight line 114 (see FIG. 7) or a curved line 116 (see FIG. 8). The protrusion 108 has a longitudinal extension 118 running from attachment means 124 (see FIGS. 3 and 4) in the triangular region 102, where the backing pad 100 is releasably attached to the driving element and the sander 10, respectively, to the centre of the tip 114, 116 of the protrusion 108. The width (essentially perpendicular to the longitudinal extension 118) of the trapezoid form becomes smaller towards the tip 114 of the protrusion 108. In the case of a straight line 114 at the tip of the protrusion 108, the line 114 extends preferably perpendicular to the longitudinal extension 118 of the protrusion 108. In the case of a curved line 116, the tip preferably comprises a convex line curved outwards. The lateral lines 112 limiting the protrusion 108 to the sides and running towards the tip 114, 116 of the protrusion 108 are straight lines. Of course, the lateral lines 112 could also be curved, in particular they could be convex lines curved outwards. The lateral lines 112 limiting the protrusion 108 to its sides interconnect the lateral lines 106 of the triangular region 102 of the backing pad 100 with the ends of the line 114, 116 forming the tip of the protrusion 108.

For easier entry of the protrusion 108 into particularly low spaces, it is suggested that the protrusion 108, at least at its tip 110, 114, 116, has a thickness which is smaller than the thickness of the triangular region 102 of the backing pad 100. As can be seen in FIGS. 3 and 4, the backing pad 100 comprises a resilient support structure 120 made of a rigid or semi-rigid material, e.g. plastic, metal or a compound of different materials, and a flexible yielding layer 122 made of an elastically deformable, soft material, e.g. rubber or foam rubber, inextricably fixed to a bottom surface of the support structure 120, e.g. by gluing, welding or co-moulding. A top surface of the backing pad 100 and of the support structure 120, respectively, comprises attachment means 124 for releasable attachment of the backing pad 100 to the sander 10 and the driving element, respectively. The attachment means 124 comprise at least one recess 126 is adapted to receive at least one respective driving element of the sander 10 in an axial direction. The at least one recess 126 has an inner circumferential form corresponding to an outer circumferential form of the at least one respective driving element of the sander 10. For example, a plurality of recesses could be provided in the top surface of the backing pad 100 and of the support structure 120, respectively, around the rotational axis of the driving element, the recesses located in a distance to the rotational axis and spaced apart from each other, preferably in an equidistant manner, in a circumferential direction.

In the shown embodiment the attachment means 124 comprise a single central recess 126 having a non-circular inner circumferential form. A single driving element has an outer circumferential form corresponding to the inner circumferential form of the recess 126. In the shown embodiment the central recess 126 has a hexagonal inner circumferential form. However, it could also have a triangular, rectangular, octagonal or any other non-circular form.

Once the driving element is introduced into the central recess 126, the driving element may be releasably fixed to the attachment means 124 and the backing pad 100, respectively, in an axial direction by means of fixing means. In the embodiment shown in FIGS. 3 and 4 the fixing means comprise first magnetic elements, in particular first permanent magnets 128, located in the recess 126, facing the driving element after introduction of the driving element into the recess 124, in particular located in the bottom of the recess 126. The first permanent magnets 128 are adapted to magnetically interact with second magnetic elements (not shown), in particular second permanent magnets or ferromagnetic elements, making part of or being attached to the driving element. The embodiment of FIG. 3 has only one permanent magnet 128, and the embodiment of FIG. 4 has four permanent magnets 128 for achieving a higher magnetic force. Hence, in the embodiment of FIGS. 3 and 4, the backing pad 100 is held in connection with the driving element of the sander 10 in an axial direction by means of magnetic force. This allows for an easy and fast replacement of the backing pad 100, if necessary. For example, different types of backing pads 100 (see FIGS. 3 to 8) can be attached to the sander 10 depending on the individual intended use and the available space.

Alternatively, the fixing means could comprise a screw (not shown in the figures) introduced from a bottom side of the backing pad 100 or the flexible yielding layer 122, respectively, through a hole in the backing pad 100 in the region of the recess 126 and screwed into a threaded bore provided in a bottom side of the driving element. In that case there would be no need for the permanent magnets 128 provided in the recess 126.

The backing pad 100 according to the invention may also be provided with a plurality of holes (not shown in FIGS. 3 to 8), similar to the holes 32 of the known backing pad of FIG. 2, and internal channels through which dust-laden air from the surface currently worked by the sander 10 and a sheet-like sanding member 132 attached to the bottom surface of the backing pad 100, respectively, and/or from the surrounding environment is aspirated. In this case the sander 10 may be provided with an internal air aspiration system for aspiring the dust-laden air through the holes and the internal channels in the backing pad 100 and for conveying it into a filter or towards a vacuum cleaner.

Figure 3:
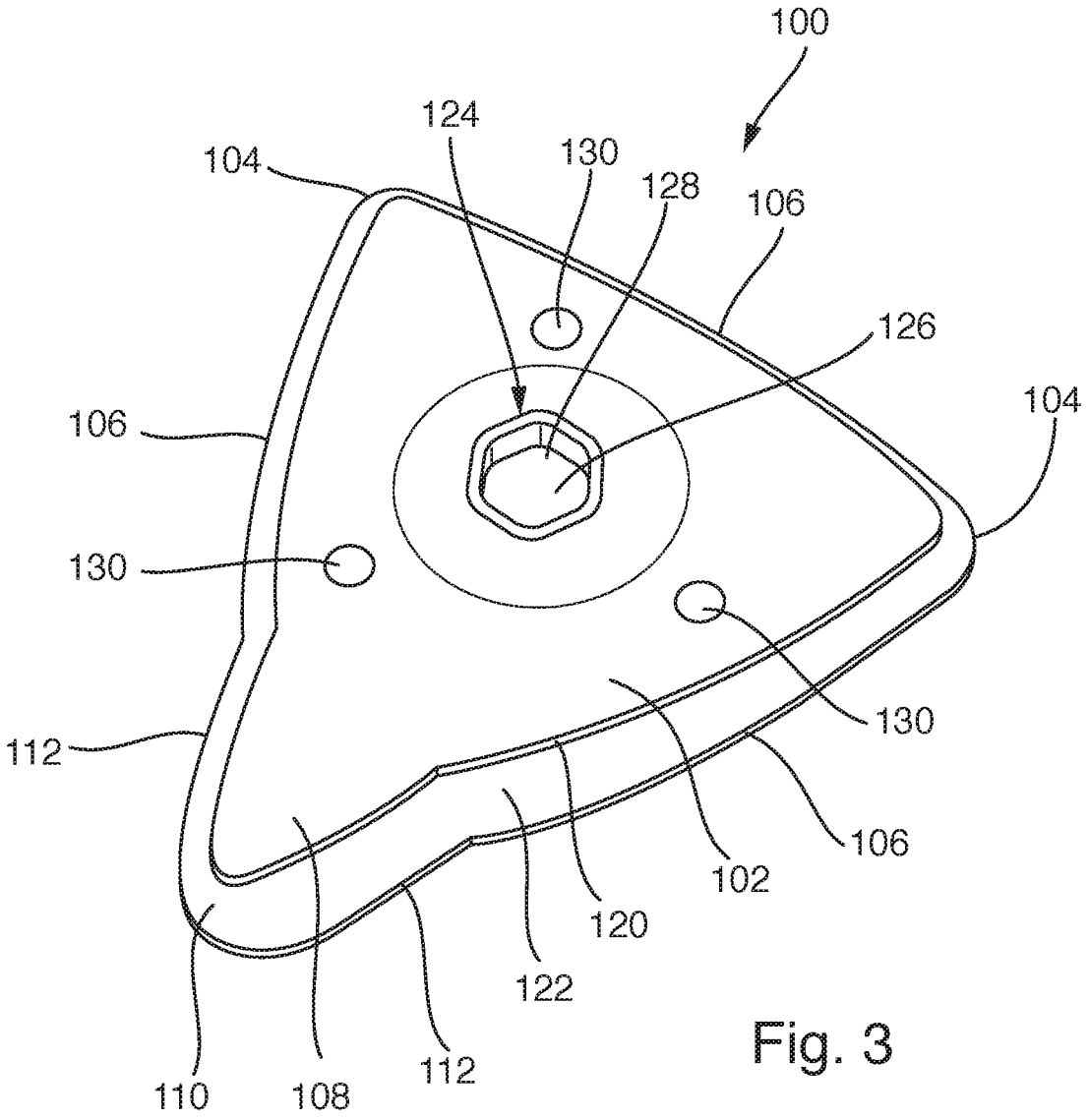
FIG. 3 a perspective view of a backing pad according to a preferred embodiment of the present invention.
Figure 4:
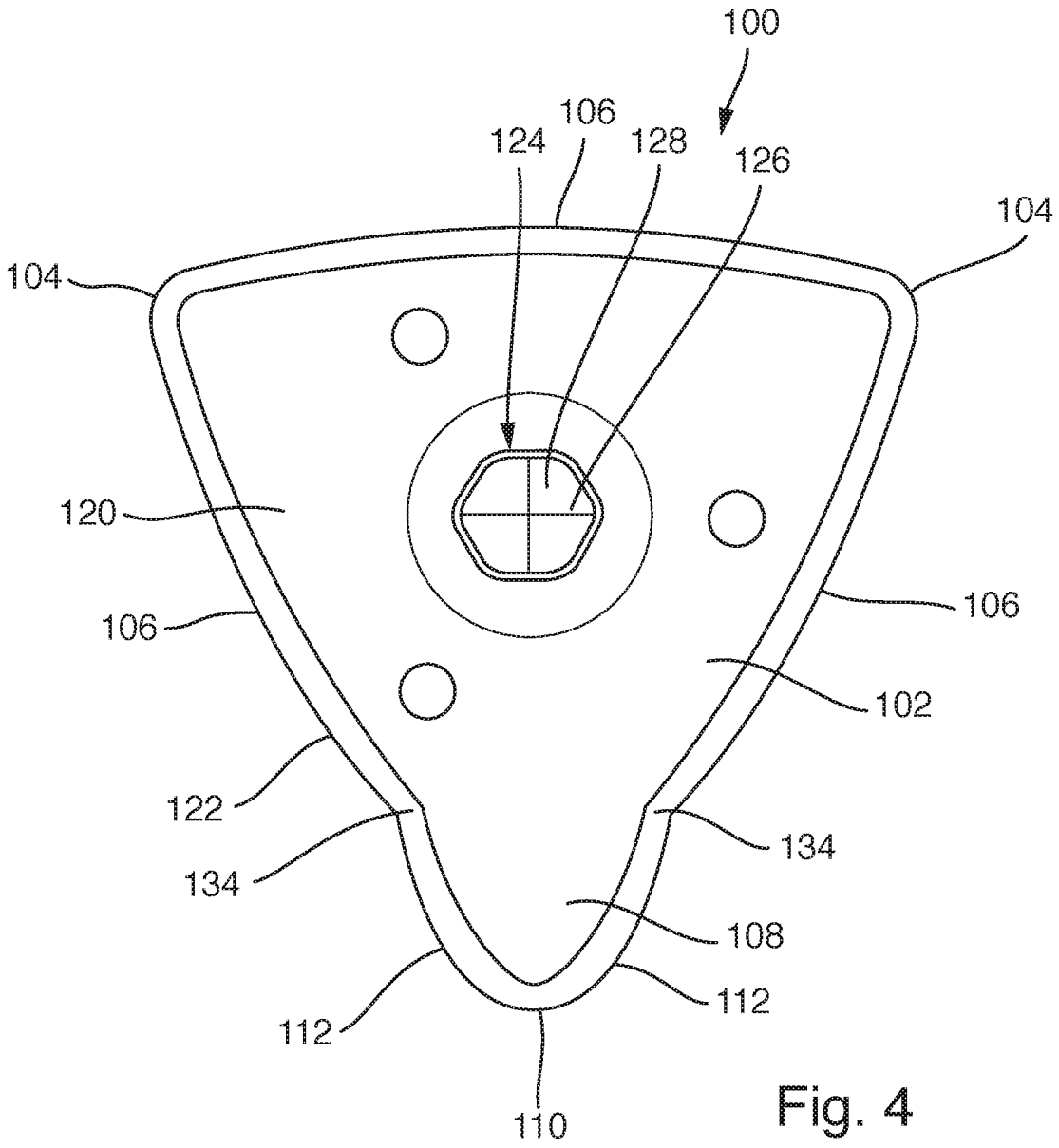
FIG. 4 a top view of the backing pad of FIG. 3.
Figure 5:
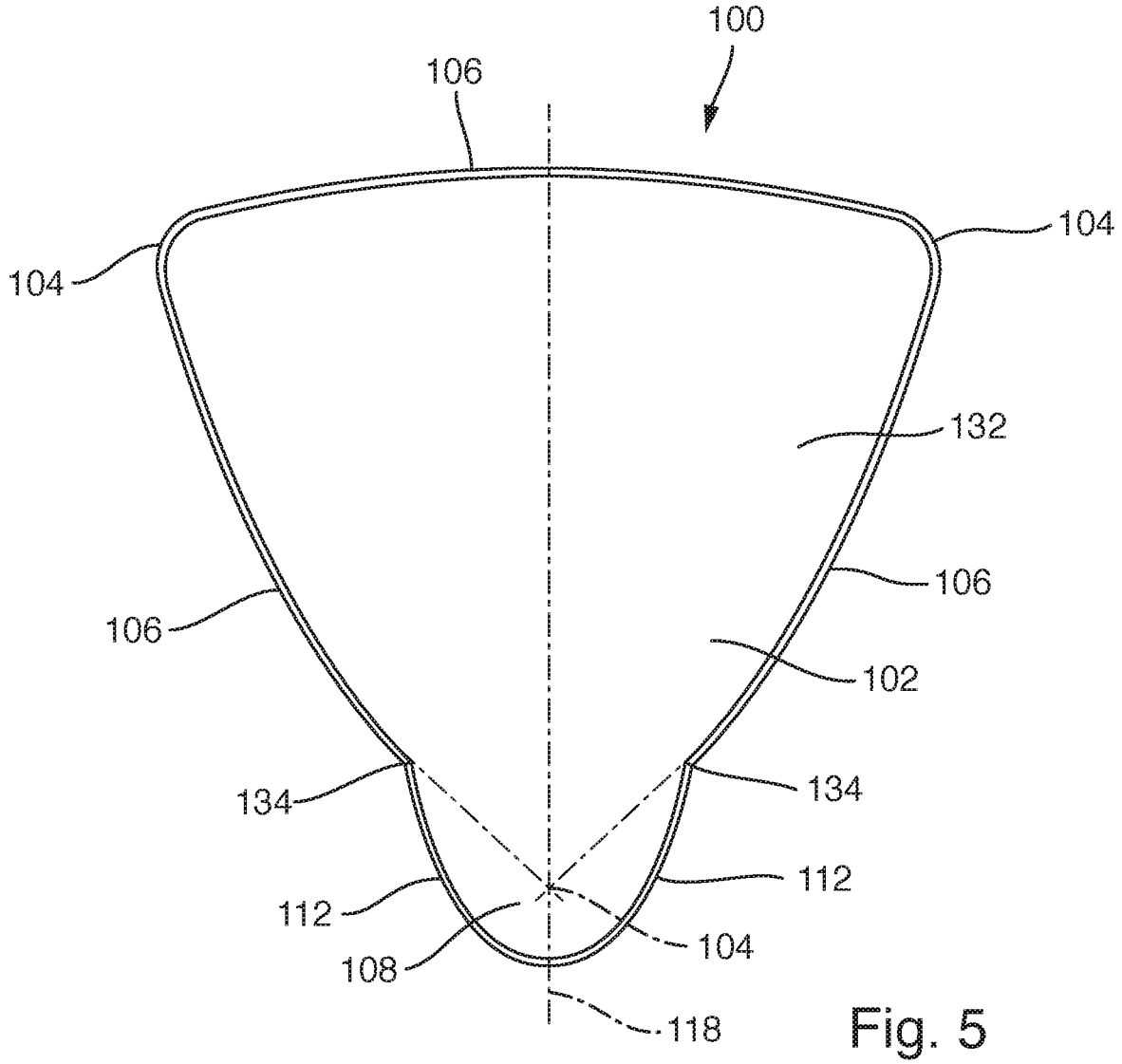
FIG. 5 a bottom view of the backing pad of FIG. 3.
Figure 6:
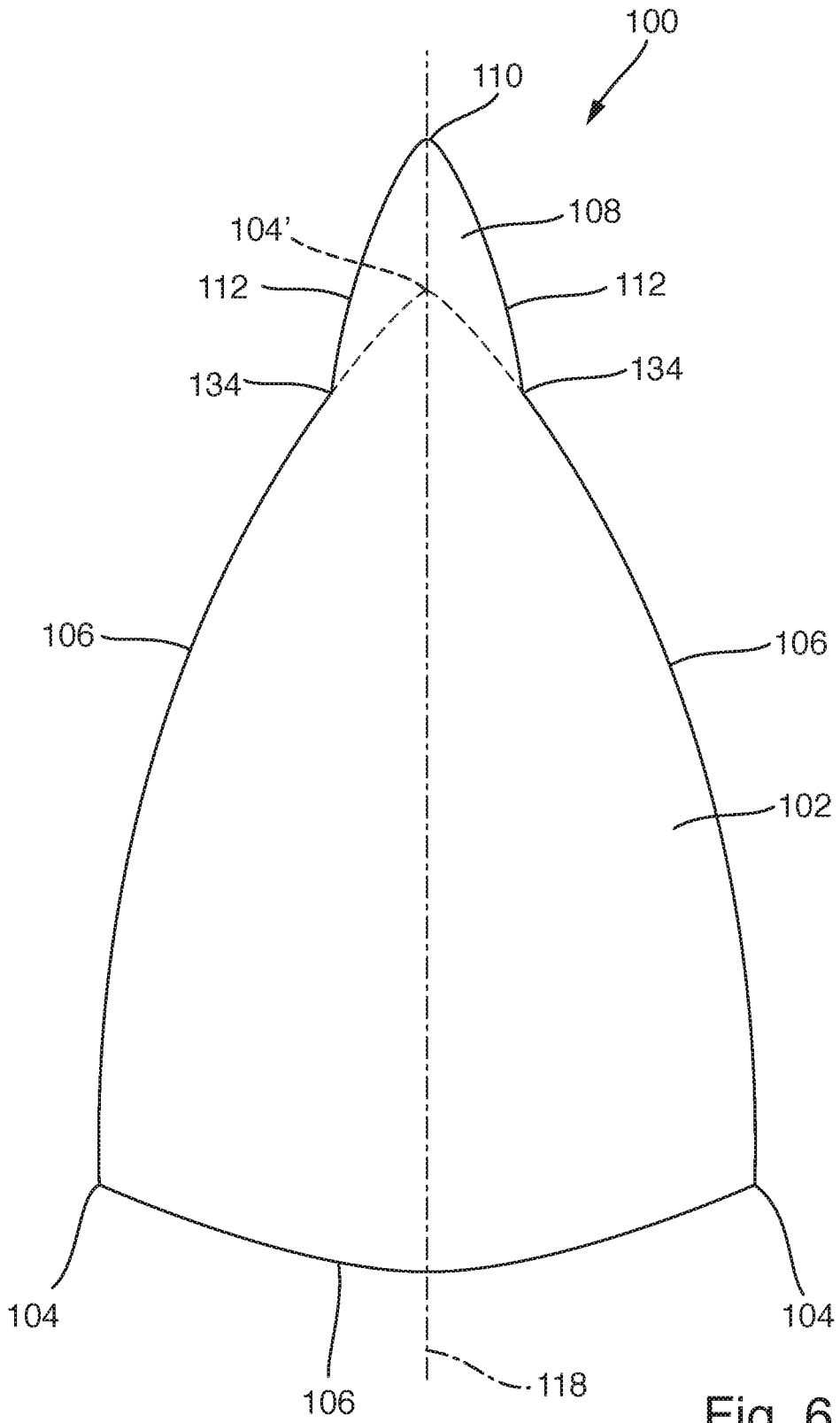
FIG. 6 a bottom view of another embodiment of a backing pad according to the present invention.

As can be seen in the embodiment of FIGS. 3 and 4, the top surface of the support surface 120 and the backing pad 100, respectively, comprises a plurality of third magnetic elements, in particular third permanent magnets 130, adapted to magnetically interact with fourth magnetic elements (not shown in the figures), in particular fourth permanent magnets or ferromagnetic elements, attached to a bottom surface of the housing 12 of the sander 10 opposite to the backing pad 100 at positions essentially corresponding to the positions of the third magnetic elements 130 of the mounted backing pad 100. These third and fourth magnetic elements 130 serve for preventing the backing pad 100 to perform a rotational movement about the rotational axis of the driving element during operation of the sander 10. The magnetic force between the third and fourth magnetic elements 130 holds the backing pad 100 in the predefined rotational position and at the same time allows an orbital movement of the backing pad 100 in respect to the housing 12 of the sander 10. The advantage of this embodiment is that the rotational movement can be prevented without friction in a contactless manner. In particular, there is no need for a flexible collar, like the collar 18 of the known sander 10 (see FIG. 1). Wear and friction losses can be reduced and at the same time the efficiency of the sander 10 is improved.

FIG. 5 shows a bottom surface of a sheet-like sanding member 132 releasably attached to the bottom surface of the yielding layer 122 and the backing pad 100, respectively. The bottom surface of the sanding member 132 comprises an abrasive material, for example, mineral, mineral-like or synthetic stone particles, for performing an abrasive work on the surface of a workpiece. The sheet-like sanding member 132 has an essentially triangular form corresponding to the form of the backing pad 100, to which it is intended to be attached. In particular, the sanding member 132 also comprises a triangular region 102 and a protrusion 108 laterally extending beyond the triangular region 102. The sanding member 132 has a top surface (not visible in FIG. 5) for releasable attachment to the bottom surface of the yielding layer 122 and the backing pad 100, respectively.

Although the present invention has been described in respect to a sander 10 and a sheet-like sanding member 132, it is understood that the invention can also be realised with a polisher. The backing pad 100 could remain essentially unchanged. In a polisher, instead of the sheet-like sanding member 132, simply a sheet-like polishing member is releasably attached to the bottom surface of the backing pad 100 by appropriate attachment means, like the attachment means 30 provided in the prior art sander 10 of FIG. 1. If necessary, the orbit and/or the speed of the polisher could be changed compared to the orbit and/or the speed of the sander 10.

The invention claimed is:

1. Backing pad for use with a hand-held or hand-guided orbital sander or polisher having a sheet-like sanding or polishing member with an essentially triangular form, with a top surface for releasable attachment to a bottom surface of the backing pad of the hand-held or hand-guided orbital sander or polisher and with a bottom surface with an abrasive or polishing material, the form of the sheet-like sanding or polishing member essentially corresponding to the form of the backing pad, wherein the sheet-like sanding or polishing member is adapted for attachment to the bottom surface of the backing pad, the backing pad having a planar extension and a corresponding essentially triangular form comprising an equilateral or isosceles triangular region with three sides, three corners and three lateral lines interconnecting the three corners and limiting the triangular region of the backing pad to the three sides, at only one of the three corners of the triangular region, a protrusion extending in a plane of the planar extension of the backing pad and projecting laterally beyond the triangular region, a corresponding top surface for releasable attachment of the backing pad to the hand-held or hand-guided orbital sander or polisher by means of attachment means, and a corresponding bottom surface for releasable attachment of the sheet-like sanding or polishing member to the backing pad, thereby covering entirely the corresponding bottom surface of the backing pad including the triangular region and the protrusion, and the overall circumferential form of the sheet-like sanding or polishing member corresponding to the overall circumferential form of the respective bottom surface of the backing pad, and a resilient support structure made of a rigid or semi-rigid material, including plastic, and a flexible yielding layer made of an elastically deformable, soft material inextricably fixed to a bottom surface of the resilient support structure, the protrusion being limited at its sides by straight or curved lateral lines interconnecting the lateral lines of the triangular region of the backing pad with a tip of the protrusion, and having a longitudinal extension extending from the attachment means to a centre of the tip of the protrusion.

2. Backing pad according to claim 1, wherein the protrusion has the form of a triangle with a pointed tip at its distal end.

3. Backing pad according to claim 1, wherein the protrusion has the form of a trapezoid, in particular of an isosceles trapezoid with a tip comprising a straight or curved line.

4. Backing pad according to claim 1, wherein the protrusion has the form of a rectangle with a tip comprising a straight or curved line.

5. Backing pad according to claim 1, wherein the backing pad comprises a discontinuity at transition points between the interconnecting lateral lines limiting the triangular region of the backing pad (100) and the straight or curved lateral lines limiting the protrusion at its sides.

6. Backing pad according to claim 1, wherein at least the tip of the protrusion has a thickness smaller than the thickness of the backing pad in the triangular region.

7. Backing pad according to claim 1, wherein the attachment means on the top surface of the backing pad for releasable attachment of the backing pad to the hand-held or hand-guided orbital sander or polisher comprise at least one recess being adapted for receiving at least one respective protruding driving element of the hand-held or hand-guided orbital sander or polisher in an axial direction, the at least one recess having an inner circumferential form corresponding to an outer circumferential form of the at least one respective protruding driving element.

8. Backing pad according to claim 7, wherein the attachment means comprise a single central recess having a non-circular inner circumferential form.

9. Backing pad according to claim 7, wherein once introduced into the at least one recess, the at least one respective protruding driving element is releasably fixed to the backing pad in an axial direction by fixing means provided in the backing pad.

10. Backing pad according to claim 9, wherein the fixing means comprise a screw introduced from the bottom side of the backing pad through a hole in the backing pad in the region of a central recess and screwed into a threaded bore in the bottom side of the at least one respective protruding driving element, or the fixing means comprise first magnetic elements located in the at least one recess, facing the at least one respective protruding driving element after introduction of the at least one respective protruding driving element into the at least one respective recess and adapted for magnetically interacting with second magnetic elements, including second permanent magnets or ferromagnetic elements, making part of the at least one respective protruding driving element.

11. Backing pad according to claim 2, wherein the protrusion has the form of an isosceles triangle.

12. Sheet-like sanding or polishing member having an essentially triangular form, with the top surface for releasable attachment to the bottom surface of a backing pad of the hand-held or hand-guided orbital sander or polisher and with the bottom surface with an abrasive or polishing material, the form of the sheet-like sanding or polishing member essentially corresponding to the form of the backing pad, wherein the sheet-like sanding or polishing member is adapted for attachment to the bottom surface of the backing pad, thereby covering the entire bottom surface of the backing pad including the triangular region and the protrusion, and wherein the overall circumferential form of the sheet-like sanding or polishing member corresponds to the overall circumferential form of the respective bottom surface of the backing pad, the backing pad having a planar extension and a corresponding essentially triangular form comprising an equilateral or isosceles triangular region with three sides, three corners and three lateral lines interconnecting the corners and limiting the triangular region of the backing pad to the three sides, at only one of the three corners of the triangular region, a protrusion extending in a plane of the planar extension of the backing pad and projecting laterally beyond the triangular region, a corresponding top surface for releasable attachment of the backing pad to the hand-held or hand-guided orbital sander or polisher by means of attachment means, and a corresponding bottom surface for releasable attachment of the sheet-like sanding or polishing member to the backing pad, thereby covering entirely the corresponding bottom surface of the backing pad including the triangular region and the protrusion, and the overall circumferential form of the sheet-like sanding or polishing member corresponding to the overall circumferential form of the respective bottom surface of the backing pad, and a resilient support structure made of a rigid or semi-rigid material, including plastic, and a flexible yielding layer made of an elastically deformable, soft material inextricably fixed to a bottom surface of the resilient support structure, the protrusion being limited at its sides by straight or curved lateral lines interconnecting the lateral lines of the triangular region of the backing pad with a tip of the protrusion, and having a longitudinal extension extending from the attachment means to a centre of the tip of the protrusion.

13. Orbital sander or polisher comprising a backing pad releasably attached thereto and performing an orbital working movement upon activation and during intended use of the orbital sander or polisher, the backing pad having a planar extension and a corresponding essentially triangular form having an equilateral or isosceles triangular region with three sides, three corners and three lateral lines interconnecting the corners and limiting the triangular region of the backing pad to the three sides, at only one of the three corners of the triangular region, a protrusion extending in a plane of the planar extension of the backing pad and projecting laterally beyond the triangular region, a corresponding top surface for releasable attachment of the backing pad to the hand-held or hand-guided orbital sander or polisher by means of attachment means, and a corresponding bottom surface for releasable attachment of the sheet-like sanding or polishing member to the backing pad, thereby covering entirely the corresponding bottom surface of the backing pad including the triangular region and the protrusion, and the overall circumferential form of the sheet-like sanding or polishing member corresponding to the overall circumferential form of the respective bottom surface of the backing pad, and a resilient support structure made of a rigid or semi-rigid material, including plastic, and a flexible yielding layer made of an elastically deformable, soft material inextricably fixed to a bottom surface of the resilient support structure, and the protrusion being limited at its sides by straight or curved lateral lines interconnecting the lateral lines of the triangular region of the backing pad with a tip of the protrusion and having a longitudinal extension extending from the attachment means to a centre of the tip of the protrusion.

14. Backing pad according to claim 1, wherein a bottom surface of the flexible yielding layer comprises attachment means for releasable attachment of the sheet-like sanding or polishing member to the backing pad.

15. Backing pad according to claim 3, wherein the protrusion has the form of an isosceles trapezoid.

16. Backing pad according to claim 4, wherein the protrusion has the form of an isosceles trapezoid.

17. Backing pad according to claim 10, wherein the first magnetic elements are first permanent magnets.

* * * * *